US005461393A

United States Patent [19]

Gordon

[11] Patent Number: 5,461,393

[45] Date of Patent: Oct. 24, 1995

[54] DUAL FREQUENCY CAVITY BACKED SLOT ANTENNA

[75] Inventor: Eldon L. Gordon, Sachse, Tex.

[73] Assignee: Texas Instruments Incorporated, Dallas, Tex.

[21] Appl. No.: 109,785

[22] Filed: Aug. 20, 1993

[51] Int. Cl.[6] ..... H01Q 13/00

[52] U.S. Cl. ..... 343/769; 343/700 MS; 343/746

[58] Field of Search ..... 343/769, 767, 343/789, 700 MS, 746; H01Q 13/00, 1/38

[56] References Cited

U.S. PATENT DOCUMENTS 2,751,589 6/1956 Cary ..... 343/767

*Primary Examiner*—Michael C. Wimer

*Attorney, Agent, or Firm*—René E. Grossman; Richard L. Donaldson

[57] ABSTRACT

A dual frequency cavity backed slot antenna and method of tuning the antenna, wherein the antenna comprises a plurality of stacked layers including a layer having a substrate with an accessible surface, the surface including thereon a continuous slot, first electrically conductive metallization disposed within the slot and extending to the slot, second electrically conductive metallization disposed external to the slot and at least one pair of frequency adjusting tabs, one tab coupled to the first metallization and the other tab coupled to the second metallization. The tabs are electrically conductive metallization, the tab coupled to said first metallization extending outwardly toward the second metallization and the tab coupled to the second metallization extending inwardly toward the first metallization. A slot is provided between the tab coupled to the second metallization and the second metallization. Each tab of a pair is coaxial with the other tab of the pair and symmetrical about the axis. Plural pairs of tabs can be symmetrically disposed about the slot. The antenna is tuned by decreasing the area of at least one of the pair of tabs to alter at least one of the resonant frequencies of the antenna.

20 Claims, 3 Drawing Sheets

DUAL FREQUENCY CAVITY BACKED SLOT ANTENNA

BACKGROUND OF THE INVENTION

1. Field of the Invention

This invention relates to dual frequency cavity backed slot antennas and, more specifically, to such antennas which can be accurately tuned for operation at both operating frequencies by adjustment made at a single accessible surface thereof.

2. Brief Description of the Prior Art

Dual frequency cavity backed slot antennas are multilayer microstrip antennas that operate at two separate frequencies. Such antennas are mounted on a ground plane which has an opening around the edges having a width and length selected according to the desired frequency characteristics of the antenna. A first top resonant microstrip layer is aligned in the plane of the ground plane and has a width and length less than the opening in the ground plane. Feed throughs (probes) electrically connect the microstrip element to a feed network. A container formed of a bottom and two sidewalls surrounds the antenna. Separating the first top resonant microstrip element from a bottom ground plane is a second resonant microstrip element mounted parallel to the first top microstrip element and electrically coupled to the feed probes. The container is electrically connected to the ground plane. The radiation slot or separation is the difference in the dimensions of the resonant microstrip elements and the opening or edges of the ground plane. The radiation slot may be covered with a thin membrane or microwave absorber.

At each frequency, the antenna circuit described above has very high quality factor (Q) which yields a narrow bandwidth. Because of material and manufacturing process variations, the resonant frequency or frequencies may offset from the desired operating frequency or frequencies. This is not a problem for one of the two resonant frequencies since the top resonant microstrip circuit is readily accessible and can be tuned after assembly to its selected resonant frequency. However, the second element is not accessible and therefore cannot be tuned subsequent to manufacturing assembly. It is therefore apparent that there exists the need of a capability to fine tune the antenna to either or both resonant frequencies of the antenna after the manufacturing assembly is complete.

There is no known published prior art relating to tuning a dual frequency cavity backed slot antenna. While stacked microstrip patch antennas are known and, at first glance may appear to be similar to dual frequency cavity backed slot antennas, these antennas differ from each other very significantly. In the stacked patch antenna, the metallized area on the upper layer does not extend to the edge. Therefore, no slot is formed on the first circuit layer. The metallization on the first circuit layer is then similar to that on the second circuit layer. There is no conductive cavity. In addition, the stacked patch antenna is usually mounted in the host with its bottom side flush with the host surface. This results in an antenna which forms a protrusion on the host surface. In contrast, the cavity backed dual frequency slot antenna mounts in the host flush with the host upper surface, in a conformal manner therewith and is surrounded by a conductive cavity. There is no protrusion above the host surface.

SUMMARY OF THE INVENTION

The above noted need is provided in accordance with the present invention by fine tuning to both of the resonant frequencies ($L_1$ and $L_2$) of the antenna by simple adjustment to only the circuit on the first circuit layer. Briefly, there is provided a dual frequency cavity backed slot antenna which includes four levels. The topmost level or first circuit layer comprises a dielectric substrate having an upper metallized surface with an unmetallized continuous slot in the metallized surface. One of the resonant frequencies, $L_1$, at which the antenna operates is primarily determined by the dimensions of the metallized region within the continuous slot. The metallization exterior to the slot extends to the edge of the upper surface of the substrate and forms a ground plane which extends to the ground plane of the host surface. The second level, which is adjacent to the topmost level, is composed of a dielectric substrate with a metallic layer thereon and acts as a tuning septum as opposed to a patch and is considerably different sized than it would be for a stacked patch antenna. The back side of the second level is also fully metallized except for feed probe access. The dimensions of the metallic layer on the second level primarily determines the other of the resonant frequency, $L_2$, at which the antenna operates. The second level has no slot and does not extend to the edges of the substrate. The third and fourth layers are stripline hybrids and provide a circuit which drives the antenna in circular polarization mode. These layers have no impact on frequency tuning. There are two feed points on the antenna. One feed point drives the antenna in the x-direction and the other feed point drives the antenna in the y-direction. The two modes are combined in a 90 degree hybrid to produce circular polarization. Feed throughs extend to the topmost level, one for each axis. When the antenna is mounted in the host, its upper surface is mechanically flush with and electrically continuous therewith. The conductive cavity completely encloses the antenna. All metallization is electrically conductive, usually copper.

Tuning adjustment is provided on the topmost level or first circuit layer by altering the area of both the metallized region within the slot and the metallized region external to the slot. This is accomplished by providing tabs on both the metallized region within the slot and the metallized region external to the slot and then adjusting the dimensions of the tabs by removing metal from each of the tabs. The tab on the metallized region within the slot extends toward the metallized region external to the slot and the tab on the metallized region external to the slot extends toward the metallized region within the slot. Two adjacent contiguous tabs extending in opposite direction from each side of the slot do not provide desired results due to phasing error of the nonsymmetrical design. It follows that symmetry of design is important. There can be more than one tab extending from either or both the metallized region within the slot or the metallized region external to the slot. If plural tabs are provided on any region, they are preferably but not necessarily symmetrically arranged with respect to each other. When plural tabs are provided from either or both of the regions, adjustment of tab dimension is preferably but not necessarily provided on a symmetrical basis. The tab sides are preferably spaced from or have slots therealong to assist in determining the amount of tab removed. If the topmost level is rectangular and the metallization within the slot is also rectangular, when x and y axes provide four equally dimensioned portions in the metallization within the slot, one feed through will be positioned along the x axis and the other feed through will be positioned along the y axis, both spaced equally from the intersection of the x and y axes.

In operation, the upper two levels of the dual frequency cavity backed slot antenna are assembled together and the antenna is tested to determine the resonant frequencies thereof with the dimensions of the metallization and the slot on the top level and the dimensions of the metallization on the second level be adjusted to provide the antenna with the desired dual resonant frequencies. The first circuit and the second circuit are initially sized to produce resonant frequencies below the desired frequency. The tabs are then adjusted in dimension by removal of a portion thereof to provide the required tuning. After tuning the upper two layers are assembled to the lower two layers (the stripline hybrid).

DESCRIPTION OF THE PREFERRED EMBODIMENT

Figure 1:
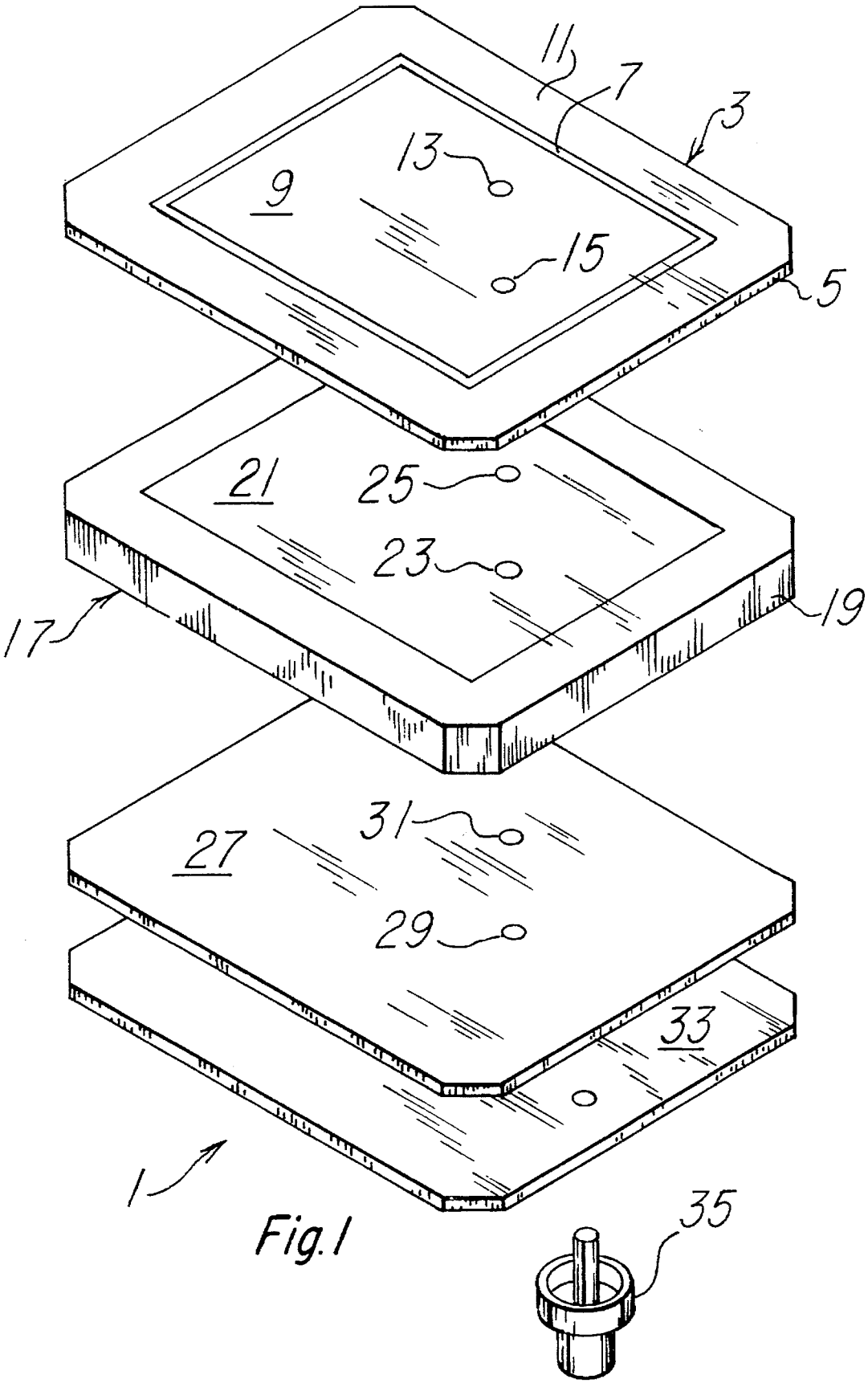
FIG. 1 is an exploded view f a dual frequency cavity backed slot antenna prior to tab formation.

Referring first to FIG. 1, there is shown an exploded view of a cavity backed dual frequency slot antenna 1. The antenna 1 includes four levels, the top level 3 including a substrate 5 of electrically insulating material, typically TMM-10, having a relative dielectric constant of about 10. The top surface of the level 3 includes a radiating slot 7 with metallization 9 within the slot and metallization 11 external to the slot. The metallization 9 is dimensioned to provide a first predetermined resonant frequency and the metallization 11 provides the ground plane and extends to the edges of the substrate 5. Feed throughs (not shown) terminate at terminations 13 and 15. A second level 17 includes a substrate 19 of electrically insulating material having a relative dielectric constant of about 10, typically TMM-10, with a patch of metallization 21 in the central region thereof which does not extend to the edge of the substrate and metallization on the back side thereof (not shown). A pair of apertures 23 and 25 are provided through the metallization 21 and the metallization on the back side for the feed probes (not shown). The third layer 27 is a stripline hybrid substrate of lower relative dielectric constant of about 3, typically TMM-3, having apertures 29 and 31 extending therethrough for the feed throughs (not shown) and the fourth layer 33 is similar to the third layer. A connector 35 connects the feed throughs to the antenna 1. The layers 27 and 33 are a standard stripline microwave circuit which forms a 90 degree hybrid which drives the antenna to circular polarization through the two feed probes as described in the above noted application.

Figure 2:
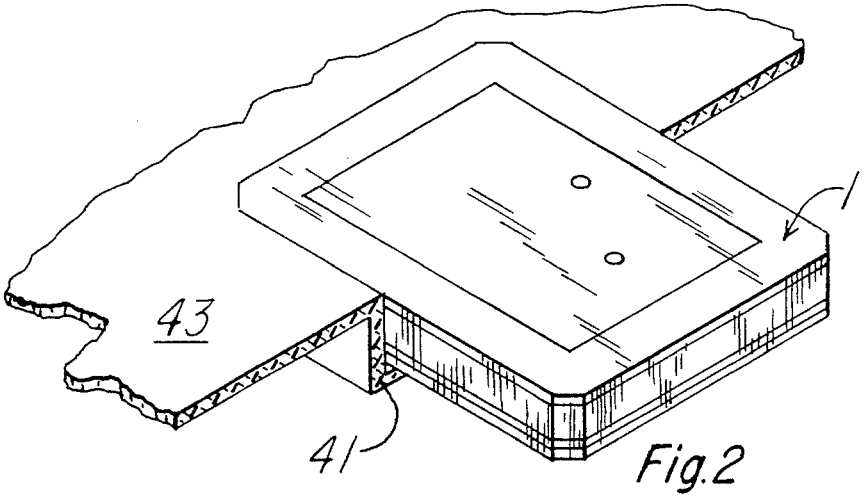
FIG. 2 is a perspective view of the antenna of FIG. 1 in assembled form mounted on a host surface.

Referring now to FIG. 2, there is shown the antenna 1 disposed in a cavity 41 of electrically conductive material which is electrically connected by conductive tape or other means to the metallization 11 and provides part of the ground plane. The cavity 41 retains the antenna 1 therein. The antenna 1 is disposed in a host 43, such as the wing of an airplane, and is positioned so that the topmost surface of the circuit 1 layer 3 is conformal to the host surface.

Figure 3:
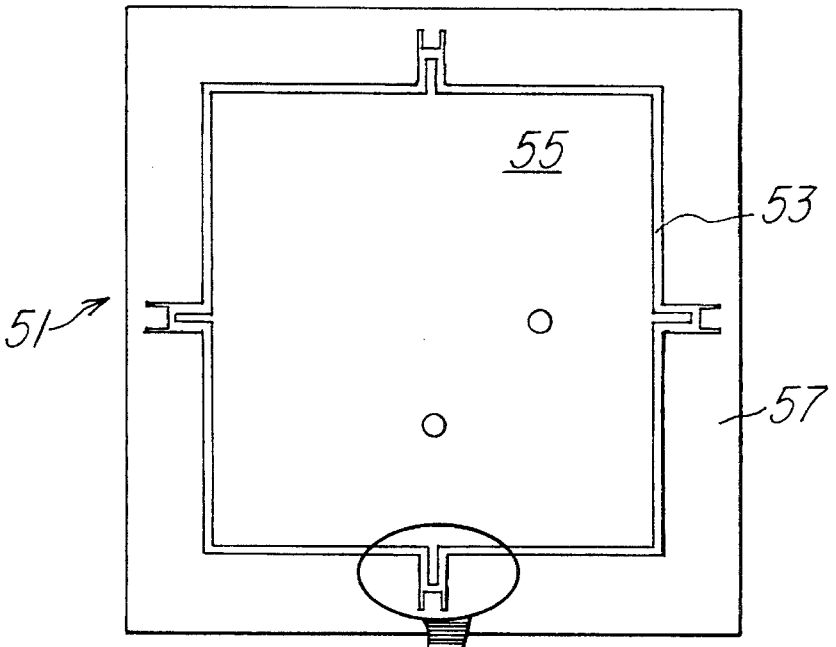
FIG. 3 is a top view of the topmost surface of an antenna in accordance with the present invention.
Figure 4:
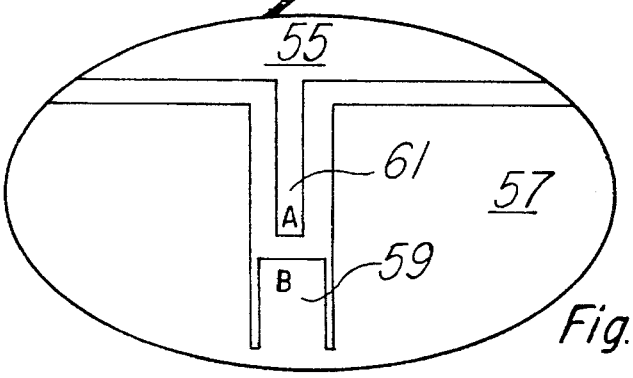
FIG. 4 is an enlarged view of one of the tab pairs of FIG. 3.

Referring now to FIGS. 3 and 4, there is shown the circuit 1 layer of the antenna of FIG. 1 with the inventive features therein. The upper surface 51 includes a slot 53 (corresponding to slot 7) with metallization 55 (corresponding to metallization 9) within the slot and metallization 57 (corresponding to metallization 11) exterior to the slot. The metallization 55 has outwardly extending tabs 61, better shown in FIG. 4, and the metallization 57 has inwardly extending tabs 59, better shown in FIG. 4. Shortening of outwardly extending tab 61 will cause an increase in the two resonant frequencies $L_1$ and $L_2$ of the antenna, shortening of inwardly extending tab 59 will cause a decrease in the $L_2$ resonant frequency with the $L_1$ resonant frequency being substantially unaffected.

Figure 5:
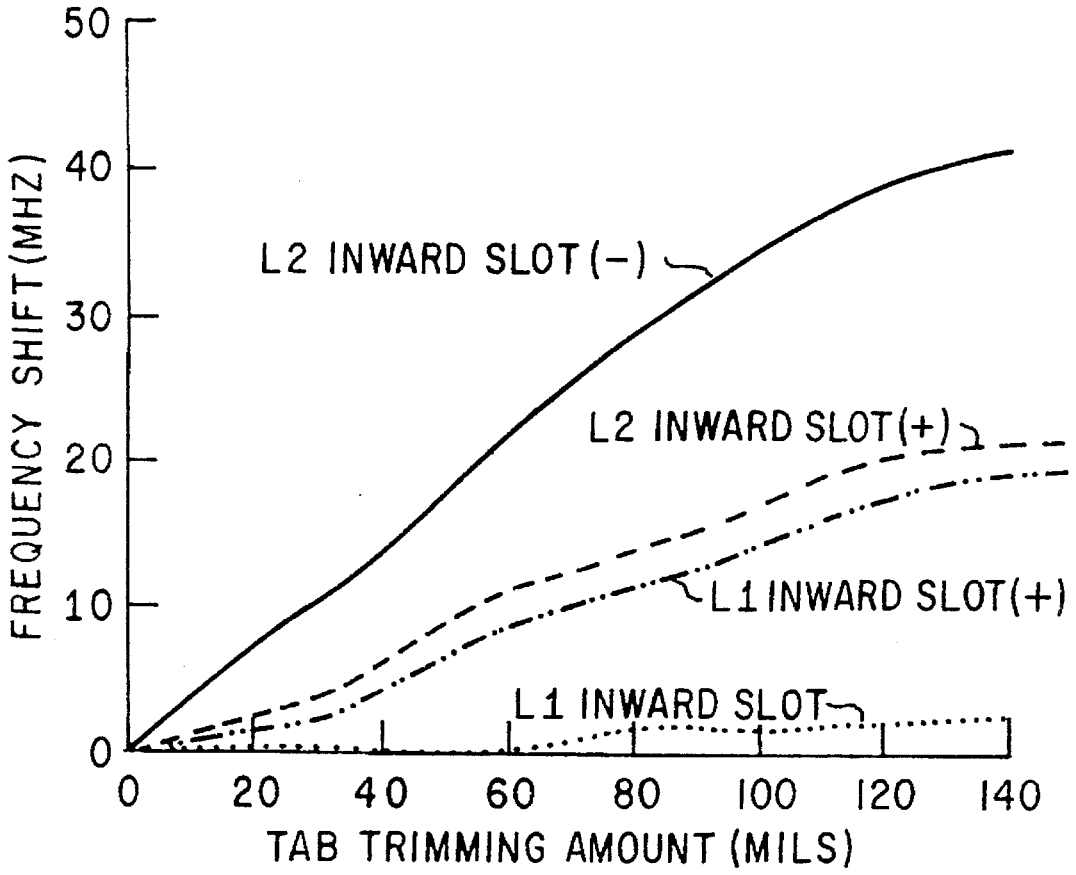
FIG. 5 is a graph showing typical changes in resonant frequency of a dual frequency cavity backed slot antenna with adjustment in the length of the inwardly and outwardly extending tabs.

Referring now to FIG. 5, there is shown a graph of the change in antenna resonant frequency with change in tab length. It can be seen that trimming of the inwardly directed tab, such as tab 59 of FIG. 4, provides a continual lowering of the resonant frequency $L_2$ and essentially no change in the resonant frequency $L_1$ whereas trimming of the outwardly directed tab, such as tab 61, of FIG. 4 causes a continual increase in the resonant frequency of both $L_1$ and $L_2$. Accordingly, by trimming (or enlarging) the dimensions of the tabs 59 and 61, an adjustment of the resonant frequency of either $L_1$ or $L_2$ or both can be provided.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modification.

I claim

1. A dual frequency cavity backed slot antenna comprising:

(a) a plurality of stacked layers including a layer having a substrate with a surface, said surface including thereon:

(i) a continuous slot;

(ii) first electrically conductive metallization disposed internal of said slot and extending to said slot;

(iii) second electrically conductive metallization disposed external to said slot and extending to said slot; and (iv) at least one pair of frequency adjusting means, one of said pair of frequency adjusting means formed by a portion of said first metallization and the other of said pair of frequency adjusting means formed by a portion of said second metallization, said frequency adjusting means comprising:

(v) a pair of coaxial frequency adjusting tabs of electrically conductive metallization symmetrical about an axis, the tab formed by said first metallization extending outwardly toward said second metallization and the tab formed by said second metallization extending inwardly toward said first metallization.

2. The antenna of claim 1 wherein said tab formed by said second metallization includes side portions, a portion of said slot disposed between said side portions and said second metallization.

3. The antenna of claim 1 wherein each of said tabs is a variable length tab.

4. A dual frequency cavity backed slot antenna comprising:

(a ) a plurality of stacked layers including a layer having a substrate with a surface, said surface including thereon:

(i) a continuous slot;

(ii) first electrically conductive metallization disposed internal of said slot and extending to said slot;

(iii) second electrically conductive metallization disposed external to said slot and extending to said slot; and (iv) at least one pair of frequency adjusting means, one of said pair of frequency adjusting means formed by a portion of said first metallization and the other of said pair of frequency adjusting means formed by a portion of said second metallization, said frequency adjusting means comprising:

(v) a pair of coaxial frequency adjusting tabs of electrically conductive metallization symmetrical about an axis, the tab formed by said first metallization extending outwardly toward said second metallization and the tab formed by said second metallization extending inwardly toward said first metallization;

(vi) further including plural pairs of said tabs.

5. The antenna of claim 4 wherein said tab formed by said second metallization includes side portions, a portion of said slot disposed between said side portions and said second metallization.

6. The antenna of claim 4 wherein each pair of said pairs of tabs is symmetrically disposed on said surface.

7. The antenna of claim 5 wherein each pair of said pairs of tabs is symmetrically disposed on said surface.

8. A dual frequency cavity backed slot antenna comprising:

(a) a plurality of stacked layers including a layer having a substrate with a surface, said surface including thereon:

(i) a continuous slot;

(ii) first electrically conductive metallization disposed internal of said slot and extending to said slot;

(iii) second electrically conductive metallization disposed external to said slot and extending to said slot; and (iv) at least one pair of frequency adjusting means, one of said pair of frequency adjusting means formed by a portion of said first metallization and the other of said pair of frequency adjusting means formed by a portion of said second metallization, said frequency adjusting means comprising:

(v) a pair of coaxial frequency adjusting tabs of electrically conductive metallization symmetrical about an axis, the tab formed by said first metallization extending outwardly toward said second metallization and the tab formed by said second metallization extending inwardly toward said first metallization;

(vi) wherein said tab formed by said second metallization includes side portions, a portion of said slot disposed between said side portions and said second metallization;

(vii) wherein each of said tabs is a variable length tab.

9. A dual frequency cavity backed slot antenna comprising:

(a) a plurality of stacked layers including a layer having a substrate with a surface, said surface including thereon:

(i) a continuous slot;

(ii) first electrically conductive metallization disposed internal of said slot and extending to said slot;

(iii) second electrically conductive metallization disposed external to said slot and extending to said slot; and (iv) at least one pair of frequency adjusting means, one of said pair of frequency adjusting means formed by a portion of said first metallization and the other of said pair of frequency adjusting means formed by a portion of said second metallization, said frequency adjusting means comprising:

(v) a pair of coaxial frequency adjusting tabs of electrically conductive metallization symmetrical about an axis, the tab formed by said first metallization extending outwardly toward said second metallization and the tab formed by said second metallization extending inwardly toward said first metallization;

(vi) wherein each of said tabs is a variable length tab;

(vii) further including plural pairs of said tabs.

10. The antenna of claim 9 wherein tab formed by said second metallization includes side portions, a portion of said slot disposed between said side portions and said second metallization.

11. The antenna of claim 9 wherein each pair of said pairs of tabs is symmetrically disposed on said surface.

12. The antenna of claim 10 wherein each pair of said pairs of tabs is symmetrically disposed on said surface.

13. A method of tuning a dual frequency cavity backed slot antenna comprising the steps of:

(a) providing an antenna structure having a plurality of stacked layers including a layer having a substrate with a surface, said surface including thereon a continuous slot, first electrically conductive metallization disposed internal of said slot and extending to said slot, second electrically conductive metallization disposed external to said slot and extending to said slot and at least one pair of frequency adjusting means, one of said pair of frequency adjusting means formed by a portion of said first metallization and the other of said pair of frequency adjusting means formed by portion of said second metallization, said frequency adjusting means comprising a pair of coaxial frequency adjusting tabs of electrically conductive metallization symmetrical about an axis, the tab formed by said first metallization extending outwardly toward said second metallization and the tab formed by said second metallization extending inwardly toward said first metallization; and (b) altering at least one of said pair of frequency adjusting means to alter at least one of the resonant frequencies of said antenna.

14. The method of claim 13 wherein said step of altering comprises changing the area of at least one of said tabs.

15. The method of claim 14 wherein said step of changing the area of at least one of said tabs comprises changing the length of said at least one of said tabs in a direction along said axis.

16. The method of claim 15 wherein said step of changing the length of said at least one of said tabs comprises removing a portion of the metallization comprising said at least one of said tabs.

17. The method of claim 14 wherein said step of changing the area of at least one of said tabs comprises the step of adding metallization to said at least one of said tabs.

18. The method of claim 15 wherein said step of changing the length of at least one of said tabs comprises the step of adding metallization to said at least one of said tabs.

19. The method of claim 17 further comprising the step of removing a portion of the added metallization.

20. The method of claim 18 further comprising the step of removing a portion of the added metallization.

* * * * *